US005229730A

United States Patent [19]

Legatti et al.

[11] Patent Number: 5,229,730

[45] Date of Patent: Jul. 20, 1993

[54] RESETTABLE CIRCUIT INTERRUPTER

[75] Inventors: Raymond H. Legatti; Frank S. Brugner; Raymond J. Wood, all of Clearwater, Fla.

[73] Assignee: Technology Research Corporation, Clearwater, Fla.

[21] Appl. No.: 746,360

[22] Filed: Aug. 16, 1991

[51] Int. Cl.[5] ..... H01H 73/00

[52] U.S. Cl. ..... 335/18; 335/202

[58] Field of Search ..... 335/18, 202; 361/42-50; 307/326

[56] References Cited

U.S. PATENT DOCUMENTS 4,719,437 1/1988 Yun ..... 335/18

*Primary Examiner*—Lincoln Donovan

*Attorney, Agent, or Firm*—Wood, Phillips, VanSanten, Hoffman & Ertel

[57] ABSTRACT

A resettable circuit interrupter for ALCI and GFCI applications utilizes movable contacts mounted on contact spring arms adjacent a U-shaped bight of the spring arm. Closing of the contacts is achieved by compression of the bight by an actuating member that is latched in the closed contact position. Unlatching of the actuating member results when current imbalances are detected, so that the contacts are opened by the bias forces produced by the contact spring arms. A reset button is located in a recess between the prongs of the plug-in member so that the device can be reset only when it is unplugged from an electrical receptacle.

11 Claims, 2 Drawing Sheets

RESETTABLE CIRCUIT INTERRUPTER

BACKGROUND OF THE INVENTION

1. Field of the Invention

This invention relates generally to a device for interrupting a circuit in the event of unbalanced currents to and from a load, and more specifically, this invention relates to a resettable circuit interrupter that is encapsulated in a plug-in unit.

2. Description of the Prior Art

A number of situations exist in which an imbalance in current flow to a load and in the return line to the source creates hazards or undesired conditions. Circuit interrupters are employed to disconnect power from the load in the event of such hazardous or undesired conditions. Specific examples of the type of circuit interrupter utilized include the appliance leakage circuit interrupter (ALCI) and the ground fault circuit interrupter (GFCI).

Various types of ALCI's and GFCI's have been utilized in the past. Frequently, the ALCI or GFCI is included in the circuit of an electrical receptacle outlet box or in the appliance or other electrical device being plugged into the receptacle. However, when such built in devices are not utilized, it is desirable to have a protective circuit interrupter that can be plugged into the receptacle to protect any appliance or other device that is to be energized from that receptacle.

After such a circuit interrupter has been actuated, either as the result of an undesired situation, such as a ground fault current, or by a momentary line surge, it is desirable to be able to reset the device for future use. However, it is also necessary that the resetting not take place when power is being applied to the load, when a ground fault exists, as a dangerous condition could be perpetuated. Accordingly, provision has to be made for resetting such that power is not conveyed to the load during the resetting operation.

Various types of resettable circuit interrupters have been utilized in the past. A resettable device for use in undervoltage protection is illustrated in U.S. Pat. No. 4,567,456—Legatti, assigned to the same assignee as the present invention. Another example of a reset mechanism utilized in connection with a GFCI incorporated into an electrical receptacle wall box is found in U.S. Pat. No. 4,209,762—Samborski et al. Although illustrative of resettable devices, these prior art arrangements do not utilize the approach of the present invention.

In addition to the basic operational requirements, such plug-in circuit interrupters should be relatively small, simple and as low cost as possible. The resettable circuit interrupter of this invention satisfies those requirements.

SUMMARY OF THE INVENTION

In the resettable circuit interrupter of this invention, the housing has a pair of projecting prongs to be inserted into the electrical receptacle. Within the housing a pair of fixed contacts are mounted. A pair of movable contacts are provided, each of the movable contacts being adapted to selectively engage a corresponding one of the fixed contacts.

The movable contacts are each mounted on a contact spring arm. The contact spring arm has one end mounted in the housing, with a generally U-shaped bight portion formed at the other end. The movable contact is located on the contact spring arm outside of the bight portion.

Each movable contact and its associated fixed contact form a switch, one such switch being located in the power line, while the other switch is located in the neutral line. Although a single switch in the power line could be utilized, it is preferable to open both the power line and the neutral line for greater safety.

An actuating member is adapted to engage each of the contact spring arms on the side of the bight portion away from the movable contacts. In the particular embodiment disclosed herein, the actuating member is generally U-shaped, with a slot formed adjacent the end of each arm. The part of the bight portion opposite the movable contact is inserted into a respective one of the slots, so that a shoulder portion of the actuating member bears against the outside of the bight, while a projection from the actuating member extends through the bight. When the actuating member is caused to close the contacts, the shoulder portion compresses the bight to cause the movable contact to engage the fixed contact. Compression of the bight portion provides contact closing force and a follow-up for contact wear. (These results could be achieved by using a separate spring instead of the bight.) The projection through the bight helps to maintain the contact spring arms in position and prevents too great a compression of the bight portion.

When the actuating member causes the contacts to be closed, the contact spring arms provide a bias force tending to open the contacts. However, a latch member is utilized to hold the actuating member in the closed contact position.

The latch member is a flexible leg that may either be located on the housing, adapted to engage a corresponding latch section on the actuating member, or it may be mounted on the actuating member to engage a corresponding latch portion on the housing.

Upon detection of a current imbalance by a differential transformer, a solenoid is energized. The solenoid has a plunger that engages the flexible latch leg to move it to the unlatched position. When the actuating member is thus unlatched, the bias force of the contact spring arm opens the contacts.

In order to reset the device, a reset button is located on the actuating member. The reset button is located in a recessed portion of the housing between the projecting prongs, so that the device must be unplugged from the electrical receptacle before the reset button can be actuated. Depression of the reset button, when the solenoid is no longer energized, moves the contacts to the closed position, where the latching leg will maintain the actuating member until the solenoid is again energized.

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

Figure 1:
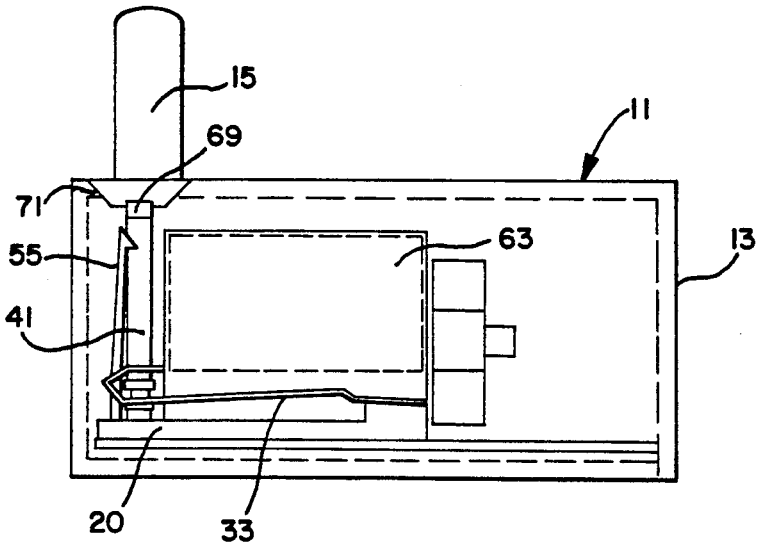
FIG. 1 is a side elevational view of the encapsulated circuit interrupter device of the present invention, partially broken away to illustrate the internal components.

A resettable circuit interrupter device 11 is illustrated in FIG. 1. Device 11 has a housing 13 made of an insulating material, such as a plastic. A prong 15 extends from housing 13 and, with a similar spaced prong, provides for plugging the device 11 into an electrical receptacle. Prong 15 and its associated prong are conventional prongs of the type utilized in electrical plugs.

Figure 3:
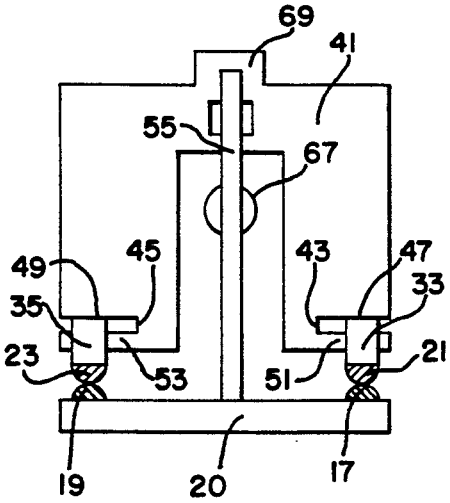
FIG. 3 is a front elevational view of the components of FIG. 2.
Figure 2:
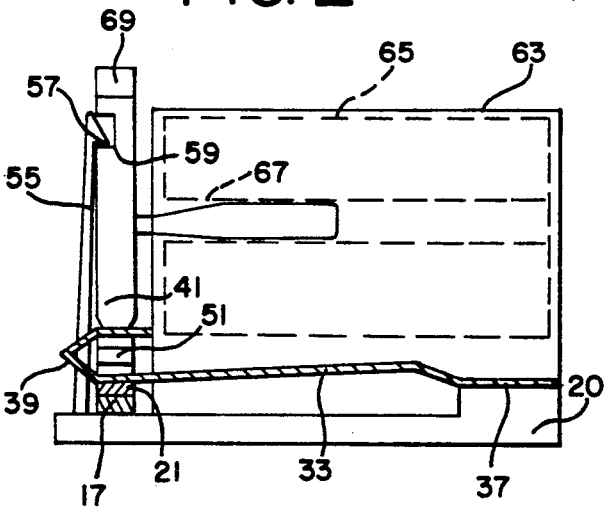
FIG. 2 is a side view, partially in elevation and partially in cross-section, illustrating the internal components of the device of FIG. 1.
Figure 5:
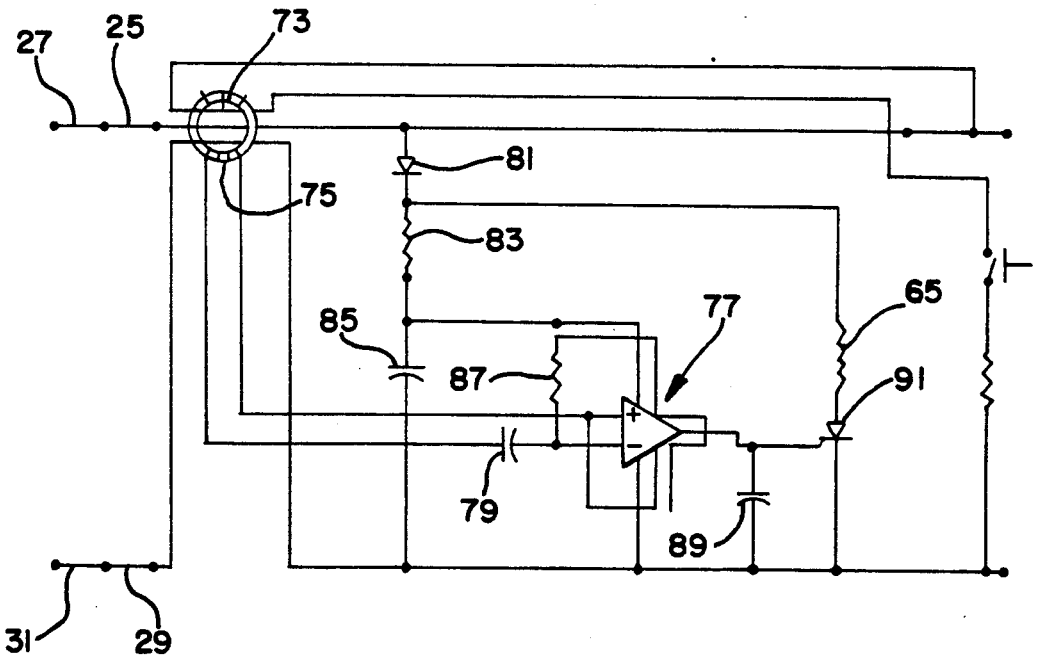
FIG. 5 is a schematic circuit diagram of the electrical circuit of the present invention.

FIGS. 2 and 3 illustrate in greater detail the components mounted in housing 13. From FIG. 3 it may be seen that a pair of fixed contacts 17 and 19 are mounted on a base 20 of housing 13. Movable contacts 21 and 23 are shown engaged with fixed contacts 17 and 19, respectively. Fixed contacts 17 and movable contact 21 form a switch 25 in a power line 27 of an electrical system (FIG. 5). Similarly, contacts 19 and 23 form a switch 29 in the neutral line 31 of the electrical system of FIG. 5. Although a single switch 25 could be utilized in some situations, it is generally preferable to open both the power and neutral lines for safety reasons.

Movable contact 21 is mounted on contact spring arm 33. Movable contact 23 is mounted on a similar contact spring arm 35. When movable contacts 21 and 23 are in engagement with fixed contacts 17 and 19, the respective contact spring arms 33 and 35 provides a bias force that tends to open the contacts.

One end 37 of contact spring arm 33 is mounted on base 20 of housing 13. The other end 39 of contact spring arm 33 is formed as a generally U-shaped bight. Movable contact 21 is mounted on contact spring arm 33 outside of the U-shaped bight.

An actuating member 41 is mounted for reciprocable motion in housing 13. Actuating member 41 is a substantially U-shaped member. Adjacent the end of each arm of the U-shaped member 41 slots 43 and 45 are formed. The upper surface of slot 43 provides a shoulder 47 that bears against the side of U-shaped bight 39 of contact spring arm 33 opposite the movable contact 21. Similarly, the upper side of slot 45 forms a shoulder 49 that bears against the U-shape bight of contact spring arm 35 opposite movable contact 23. On the other sides of slots 43 and 45 projections 51 and 53 extend through the bights of contact spring arms 33 and 35, respectively. Projections 51 and 53 serve the dual purpose of helping to position contact spring arms 33 and 35, while also preventing shoulders 47 and 49 from compressing the U-shaped bights to too great a degree.

When the actuating member 41 is in the position shown in FIGS. 2 and 3, movable contacts 21 and 23 engage their respective fixed contacts 17 and 19. Compression of the U-shaped bight by shoulder 47 (shoulder 49 in the case of contact spring arm 35) provides a contact closing force between the contacts 17 and 21. In addition, this spring force that is generated provides a follow-up for contact wear.

Actuating member 41 is maintained in the position shown in FIGS. 2 and 3 (against the opposing bias force of spring arm 33) by a latching member or leg 55. Latching leg 55 is flexible and has a latching lip 57 which engages a corresponding latching notch 59 and actuating member 41.

Figure 4:
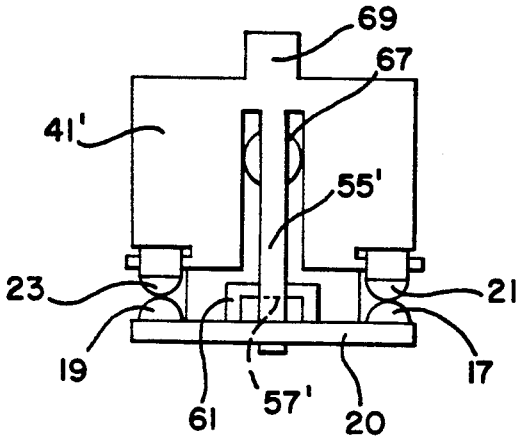
FIG. 4 is a front elevational view similar to FIG. 3 showing a second embodiment of the latch.

An alternative structure for the latching leg 55 is illustrated in FIG. 4, where the latching leg 55' is mounted on the actuating member 41' and has a latching leg 57' which engages a fixed member 61 secured to base 20 of the housing 13. The basic operation of the latching arrangement is not altered.

A solenoid 63 is mounted in the housing 13 and has a coil 65 and a plunger 67. When the coil 65 is energized, plunger 67 is forced into engagement with latching leg 55 to move it to the unlatched position. In the unlatched position, the bias force of contact spring arm 33 forces actuating member 41 and movable contact 21 away from the fixed contact 17, thus opening the contacts.

A reset button 69 is located on actuating member 41. As may be seen in FIG. 1, reset button 69 is located in a recess 71 formed in housing 13. Recess 71 is located between the prongs of the plug, so that the device cannot be reset unless it has been unplugged from the electrical receptacle. This prevents the contacts from being closed by manual resetting when power is applied to the device, thus precluding a potentially dangerous situation.

FIG. 5 illustrates the electrical circuit for the circuit interrupter device. A differential transformer 73 has both the power line 27 and the neutral line 31 passing through it. In the event of a current imbalance, the differential transformer produces a signal in the secondary winding 75. The signal in secondary winding 75 is conveyed to an amplifier 77 through a capacitor 79. Power for the amplifier 77 is obtained from power line 27 through a diode 81 and a resistor 83, as established across capacitor 85. A feed-back resistor 87 is connected to the input of the amplifier.

In the event that the differential transformer 73 detects a current imbalance, a signal is produced at the output of amplifier 77 across capacitor 89. This signal is applied to the gate of a silicon controlled rectifier (SCR) 91. The gate signal on SCR 91 triggers this SCR 91 into conduction and connects the solenoid coil 65 across the power source through diode 81 and SCR 91. Energization of the solenoid coil 65 causes plunger 67 to engage latching leg 55 and unlatch actuating member 41 to permit opening of the contacts (switches 25 and 29).

The use of the SCR also permits the elimination of a metal oxide varistor, as this circuit will withstand the 6 KV impulse test that is required by UL. When a transient voltage amplitude exceeds the forward breakover voltage of the SCR (in the range of 400–600 volts), the solenoid will energize to open the contacts and clear the circuit.

With this arrangement, a simple, low cost ALCI is provided that meets UL requirements. The basis approach employed herein can also be used for other applications, such as in GFCI products.

It should be understood the various modifications, changes and variations may be made in the arrangement, operation and details of construction of the elements disclosed herein without departing from the spirit and scope of this invention.

We claim:

1. A resettable circuit interrupter device for an electrical system having a power line and a neutral line comprising:

a housing;

a pair of prongs mounted in said housing to permit the device to be removably plugged into an electrical receptacle;

a fixed contact mounted in said housing;

a contact spring arm mounted in said housing at a first end thereof;

a movable contact to selectively engage said fixed contact and mounted adjacent a second end of said contact spring arm, said contact spring arm providing a bias force urging said movable contact away from said fixed contact when said contacts are in engagement;

an actuating member to drive said contact spring arm from the side away from said movable contact;

resilient means to convey a contact closing force from said actuating member to said movable contact;

latching means to normally maintain said actuating member in a position such that said movable contact is held in engagement with said fixed contact against the bias force of said contact spring arm;

sensing means to detect the presence of an undesired circuit condition;

a solenoid, detection of an undesired circuit condition resulting in energization of said solenoid to cause said latching means to release said actuating member, thereby permitting said bias means to separate said movable contact from said fixed contact;

manually actuatable reset means associated with said actuating member; and safety means to preclude actuation of said reset means when the device is plugged into an electrical receptacle.

2. A resettable circuit interrupter device as claimed in claim 1 and further comprising:

a second fixed contact mounted in said housing; and a second movable contact mounted on a second contact spring arm to selectively engage said second fixed contact, said second fixed and movable contacts providing a switch in the neutral line of the system.

3. A resettable circuit interrupter device as claimed in claim 2 wherein said actuating member comprises a generally U-shaped member having a slot formed in each arm adjacent the end thereof, each slot forming a shoulder to engage the bight of a corresponding contact spring arm opposite the movable contact mounted thereon and a projection to extend through the bight.

4. A resettable circuit interrupter device as claimed in claim 1 wherein said latching means comprises a flexible latching leg mounted in said housing and adapted to engage a latching surface on said actuating member to latch said actuating member in the closed contact position.

5. A resettable circuit interrupter device as claimed in claim 1 wherein said latching means comprises a flexible latching leg mounted on said actuating member to engage a fixed member mounted on said housing to latch said actuating member in the closed contact position.

6. A resettable circuit interrupter device as claimed in claim 1 wherein said sensing means comprises a differential amplifier to detect current imbalances in the power line and neutral line of the electrical system.

7. A resettable circuit interrupter device as claimed in claim 1 wherein said safety means comprises placing said manually actuatable reset means in a recess between said prongs so that said device can be reset only when it is not plugged into an electrical receptacle.

8. A resettable circuit interrupter as claimed in claim 1 wherein said resilient means comprises a U-shaped bight found in the second end of said contact spring arm.

9. A resettable circuit interrupter device for an electrical system having a power line and a neutral line comprising:

a housing;

a pair of prongs mounted in said housing to permit the device to be removably plugged into an electrical receptacle;

first and second fixed contacts mounted in said housing;

first and second contact spring arms associated with said first and second fixed contacts, respectively, each of said contact spring arms mounted in said housing at a first end thereof and having a generally U-shaped bight at a second end thereof;

a first movable contact to selectively engage said first fixed contact and mounted adjacent the second end o said first contact spring arm outside of the U-shaped bight, said first contact spring arm providing a bias force tending to drive said first movable contact away from said first fixed contact when said contacts are in engagement;

a second movable contact to selectively engage said second fixed contact and mounted adjacent the second end of said second contact spring arm outside of the U-shaped bight, said second contact spring arm providing a bias force tending to drive said second movable contact away from said second fixed contact when said contacts are in engagement, said first movable and fixed contacts forming a switch in the power line and said second movable and fixed contacts forming a switch in the neutral line;

a reciprocably movable generally U-shaped actuating member having a shoulder adjacent the end of each of the arms thereof to engage a respective one of said first and second contact spring arms on the side of the U-shaped bight opposite the associated movable contact;

a projection from each arm of said actuating member passing through the bight of the associated contact spring arm;

a flexible latching leg to releasably maintain said actuating member in a position such that the bights of said contact spring arms are compressed to forcibly engage said movable contacts with said fixed contacts against the bias force of said contact spring arms;

a differential transformer to detect current imbalances in the power and neutral lines;

a solenoid having a coil and a plunger, said plunger arranged to engage said latching leg when said solenoid coil is energized;

switching means to energize said coil of said solenoid when a current imbalance is detected by said differential amplifier, thereby unlatching said actuating member to move under the bias force of said contact spring arms to separate said movable contacts from said fixed contacts; and a reset button located on said actuating member for manually resetting the actuating member to the latched position, said reset button recessed in said housing between said prongs so that resetting can be achieved only when the device is not plugged into an electrical receptacle.

10. A resettable circuit interrupter device as claimed in claim 9 wherein said latching leg is mounted in said housing to engage a latching surface on said actuating member to latch said actuating member in the closed contact position.

11. A resettable circuit interrupter as claimed in claim 9 wherein said latching is mounted on said actuating member and is adapted to engage a fixed member mounted in the housing in order to latch said actuating member in the closed contact position.

* * * * *